US008518476B2

(12) United States Patent
Zhang et al.

(10) Patent No.: US 8,518,476 B2
(45) Date of Patent: Aug. 27, 2013

(54) METHODS FOR FORMING FLUOROPLASTIC POWDER COATINGS

(75) Inventors: Qi Zhang, Milton (CA); Yu Qi, Oakville (CA); Sandra J. Gardner, Oakville (CA); Carolyn Moorlag, Mississauga (CA); Brynn Dooley, Toronto (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/288,263

(22) Filed: Nov. 3, 2011

(65) Prior Publication Data

US 2013/0115380 A1 May 9, 2013

(51) Int. Cl.
*B05D 1/04* (2006.01)

(52) U.S. Cl.
USPC ..... 427/180; 427/457; 427/458; 427/472; 427/474; 427/475; 427/485; 427/189; 427/195; 427/201

(58) Field of Classification Search
None
See application file for complete search history.

(56) References Cited

U.S. PATENT DOCUMENTS

| | | | | |
|---|---|---|---|---|
| 2,188,007 | A * | 1/1940 | Kistler | 252/62 |
| 6,448,331 | B1 * | 9/2002 | Ioka et al. | 524/859 |
| 6,703,071 | B2 * | 3/2004 | Koslow | 427/195 |
| 2004/0058166 | A1 * | 3/2004 | Nakamura | 428/425.1 |
| 2005/0100728 | A1 * | 5/2005 | Ristic-Lehmann et al. | 428/323 |
| 2006/0263532 | A1 * | 11/2006 | Kaplan et al. | 427/385.5 |
| 2006/0263533 | A1 * | 11/2006 | Kaplan et al. | 427/385.5 |
| 2006/0263537 | A1 * | 11/2006 | Kaplan et al. | 427/421.1 |
| 2006/0263538 | A1 * | 11/2006 | Kaplan et al. | 427/421.1 |
| 2010/0226701 | A1 * | 9/2010 | Moorlag | 399/333 |
| 2012/0244469 | A1 * | 9/2012 | Zwartz et al. | 430/124.23 |
| 2012/0245251 | A1 * | 9/2012 | Moorlag et al. | 523/218 |

* cited by examiner

*Primary Examiner* — Erma Cameron
(74) *Attorney, Agent, or Firm* — MH2 Technology Law Group LLP

(57) ABSTRACT

Various embodiments provide materials and methods for forming a fluoroplastic coating layer from a powder mixture including a leveling agent and/or a transient binder material to improve the powder coating quality, wherein the powder mixture can further include a plurality of fluoroplastic powder and a plurality of aerogel particles.

20 Claims, 3 Drawing Sheets

METHODS FOR FORMING FLUOROPLASTIC POWDER COATINGS

DETAILED DESCRIPTION

Background

Polyfluoroalkoxypolytetrafluoroethylene (PFA)-based composite coatings incorporated with different filler particles are known to have resistance to corrosion, permeation, abrasion, scratch, etc. The PFA-based composite coatings are often made by powder-coating a mixture of PFA powder and the filler particles. Problems arise, however, due to low reproducibility of the composite coatings. This is because the PFA powder and the filler particles lack of interaction and they tend to separate during the powder coating process. Surface defects are then formed on the PFA-based composite coatings.

It is therefore desirable to develop materials and methods for forming a fluoroplastic coating layer having high coating quality with high reproducibility.

SUMMARY

According to various embodiments, the present teachings include a method of making a coating layer. In this method, a powder mixture can be formed to include a plurality of fluoroplastic powder, a plurality of aerogel particles, and a leveling agent including a fluorinated surfactant. The powder mixture can then be applied to a material surface and cured to form a fluoroplastic coating layer from the plurality of fluoroplastic powder on the material surface. The plurality of aerogel particles can be leveled by the leveling agent during curing to disperse within the fluoroplastic coating layer.

According to various embodiments, the present teachings also include a method of making a coating layer. In this method, a powder mixture can be formed to include a plurality of fluoroplastic powder, a plurality of aerogel particles, and a transient binder material. The plurality of aerogel particles can be attached to the plurality of fluoroplastic powder via the transient binder material. The powder mixture can then be applied to a material surface and cured to form a fluoroplastic coating layer from the plurality of fluoroplastic powder on the material surface. During curing, the transient binder material can be removed such that the plurality of aerogel particles are dispersed within the fluoroplastic coating layer.

According to various embodiments, the present teachings further include a method of making a fuser member. In this method, a powder mixture can be formed to include a plurality of polyfluoroalkoxypolytetrafluoroethylene (PFA) powder, a plurality of aerogel particles, and one or more of a leveling agent, a transient binder material, and a combination thereof. The powder mixture can be applied to one of an elastomer layer of a fuser member and a fuser member substrate. The powder mixture can be cured to form a fluoroplastic coating layer from the plurality of fluoroplastic powder as a topcoat layer of the fuser member such that the plurality of aerogel particles are uniformly dispersed within the fluoroplastic coating layer to provide a surface roughness ranging from about 0.1 μm ($S_q$) to about 5 μm ($S_q$).

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
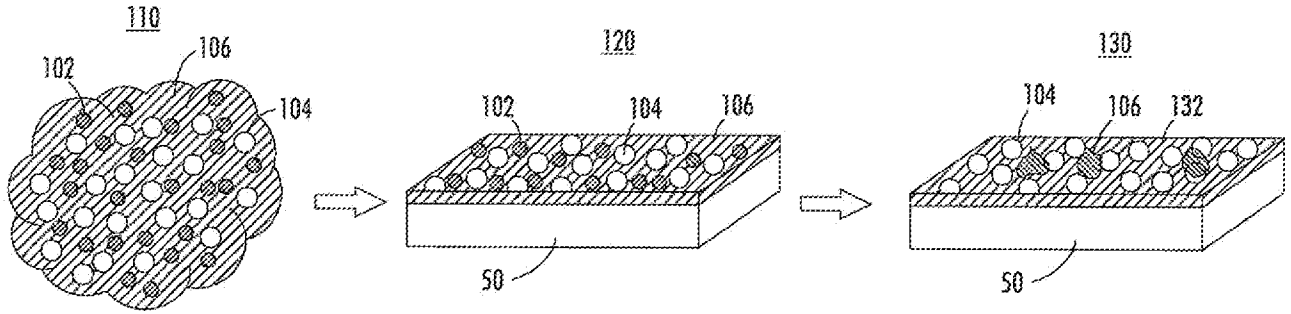
FIGS. 1-2 depict various exemplary methods of forming a fluoroplastic coating layer in accordance with various embodiments of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. The following description is, therefore, merely exemplary.

Various embodiments provide materials and methods for forming a fluoroplastic coating layer from a powder mixture by using a leveling agent and/or a transient binder material to improve the powder coating quality. In one embodiment, the fluoroplastic coating layer can include a plurality of filler particles such as aerogel particles dispersed therein. The fluoroplastic coating layer can be used as a topcoat layer of a printer member including, such as, for example, a fuser member, a pressure member, a donor member, and/or other possible printer members.

In embodiments, fluoroplastic coating layers can be formed by first forming a powder mixture; then applying the powder mixture to a material surface, e.g., using a powder coating technique; and then curing the applied powder mixture to form a fluoroplastic layer on the material surface.

The powder mixture can be formed from a powder mixture composition that includes various components of, e.g., fluoroplastic powder; filler particles; leveling agents and/or binder materials in one or more solvents. Exemplary fluoroplastic powder can include, but are not limited to, polyfluoroalkoxypolytetrafluoroethylene (PFA) powder, polytetrafluoroethylene (PTFE) powder, polytetrafluoroethylene (PTFE) powder, and fluorinated ethylenepropylene copolymer (FEP) powder, and the like, or combinations thereof. Exemplary filler particles can include, but are not limited to, aerogel particles, metal particles, and metal oxide particles.

In one embodiment, the powder mixture composition can be formed by mixing a first dispersion containing fluoroplastic powder and a second dispersion containing filler particles with a third dispersion containing leveling agents and/or binder materials. Each of the first, second and third dispersions can use the same or different solvents. In another embodiment, the fluoroplastic powder and the filler particles can be mixed with a dispersion containing the leveling agents and/or binder materials in a solvent to form a powder mixture composition. In an additional embodiment, the leveling agents and/or the binder materials can be added to a dispersion containing fluoroplastic powder and/or the filler particles. Regardless of the mixing methods, the powder mixture composition can include fluoroplastic powder, filler particles, leveling agents and/or binder materials dispersed in a solvent or a solvent mixture containing two or more solvents. The solvents can include, for example, isopropanol (IPA), methylethylketone (MEK), methyl-isobutylketon (MIBK), butanol.

By at least partially removing the solvent(s) from the powder mixture composition, the powder mixture can be formed and can also be referred to herein as "dry powder mixture." The dry powder mixture can then be powder coated to any desirable material surfaces to form a powder coating layer, for example, a fluoroplastic coating layer.

For ease of illustration, the description herein primarily relates to the powder mixture including a plurality of PFA powder, a plurality of aerogel particles, and a leveling agent and/or a binder material.

For example, after removing the solvent(s) from the powder mixture composition, the dry powder mixture can include PFA powder in an amount ranging from about 80 percent to about 99.9 percent, or from about 90 percent to about 99.5 percent, or from about 95 percent to about 99 percent by weight of the total dry powder mixture. The aerogel particles can be present in an amount ranging from about 0.1 percent to about 15 percent, or from about 0.5 percent to about 10 percent, or from about 1 percent to about 5 percent by weight of the total dry powder mixture, although the amount for each of the PFA powder and aerogel particles is not limited.

In embodiments, the exemplary PFA powder can have an average powder size ranging from about 1 μm to about 100 μm, or from about 3 to about 85, or from about 5 to about 50, although the powder size is not limited.

In embodiments, one or more types of PFA powders can be employed in the powder mixture that is subjected to a powder coating process. For example, two types of PFA powders can be used: a first type PFA powder having a small powder diameter (also referred to herein as "small PFA powder") and a second type PFA powder having a large powder diameter (also referred to herein as "large PFA powder") can be used. In embodiments, the small PFA powder can have an average powder size in the range from about 1 to about 20, or from about 3 to about 15, or from about 5 to about 10, while the large PFA powder can have an average powder size in the range from about 20 to about 100, or from about 25 to about 85, or from about 30 to about 50. In this case, a weight ratio of large PFA powder to small PFA powder can be in the range of about 10 parts of large PFA powder per about 90 parts of small PFA powder, or about 20 parts of large PFA powder per about 80 parts of small PFA powder, or about 70 parts of large PFA powder per about 30 parts of small PFA powder.

Any suitable commercially available PFA powder can be employed including, for example, MP320 from Dupont Chemical and ACX-21 from Daikin Industry Ltd. (Japan).

As used herein, the term "aerogel particle" refers to a highly porous material with low mass density. The aerogel particles can have high surface area, and high porosities. In one example, the aerogel particles can be prepared by forming a gel with pore liquid and then removing pore liquid from the gel while substantially retaining a solid phase, i.e., the gel structure. After the pore liquid is removed, the polymerized material is pyrolyzed in an inert atmosphere to form the aerogel. In some cases, the term aerogel can be used to indicate gels that have been dried so that the gel shrinks little during drying, preserving its porosity and related characteristics. In particular, aerogels can be characterized by their unique structures that include a large number of small interconnected pores.

The aerogel particles can have an average volume particle size of from the sub-micron range to about 50 microns or more. The aerogel particles can be either formed initially as the desired sized particles, or can be formed as large particles and then reduced in size to the desired size. For example, formed aerogel materials can be ground, or they can be directly formed as nano to micron sized aerogel particles. In embodiments, the aerogel particles can have an average particle size ranging from about 50 nm to about 30 μm, or from about 200 nm or about 25 μm, or from about 1 μm or about 20 μm. In embodiments, the aerogel particles can include one or more nano-sized primary particles, e.g., having an average particle size ranging from about 50 nm or about 900 nm. In embodiments, the aerogel particles can have a shape that is spherical, or near-spherical, cylindrical, rod-like, bead-like, cubic, platelet-like, and combinations thereof.

The aerogel particles can have open-celled microporous or mesoporous structures. In embodiments, the pores of aerogel particles can have an average diameter of less than about 500 nm, or from about 5 nm to about 500 nm, or from about 10 nm to about 250 nm, or from about 20 nm to about 100 nm. The aerogel particles can have an average porosity of from about or from about 50% to about 95%, or from about 60% to about 90%, or from about 70% to about 85%. The aerogel particles can have an average surface area of about 400 $m^2$ per gram or greater, or ranging from about 400 $m^2$ per gram to about 1200 $m^2$ per gram, or ranging from about 500 $m^2$ per gram to about 1000 $m^2$ per gram, or ranging from about 600 $m^2$ per gram to about 800 $m^2$ per gram. The aerogel particles can have low mass densities, e.g., ranging from about 40 $kg/m^3$ to about 100 $kg/m^3$, or from about 50 $kg/m^3$ to about 90 $kg/m^3$, or from about 60 $kg/m^3$ to about 80 $kg/m^3$.

Any suitable aerogel particles can be used including, for example, inorganic aerogels, organic aerogels, carbon aerogels, and mixtures thereof. In particular embodiments, ceramic aerogel particles can be suitably used, including, but not limited to, silica, alumina, titania, zirconia, silicon carbide, silicon nitride, and/or tungsten carbide. The aerogel particles can optionally be doped with other elements such as a metal. In some embodiments, the aerogel particles can include aerogels chosen from polymeric aerogels, colloidal aerogels, and mixtures thereof.

In embodiments, aerogel particles can be commercially available from several sources. Aerogel particles prepared by supercritical fluid extraction or by subcritical drying are available from Cabot Corp. (Billerica, Mass.), Aspen Aerogel, Inc. (Northborough, Mass.), Hoechst, A.G. (Germany), American Aerogel Corp. (Rochester, N.Y.), and/or Dow Corning (Midland, Mich.).

As used therein, the term "leveling agent" formulated in the powder mixture composition and its powder mixture refers to a surface controlling agent, e.g., to decrease the surface tension of components in the powder mixture composition and the powder mixture and/or to inhibit surface defects on the final powder coating layer (e.g., the fluoroplastic coating layer) formed from the powder mixture. The leveling agent can be a non-ionic leveling agent, an anionic leveling agent, and/or a cationic leveling agent.

In one embodiment, the leveling agent can be a fluorinated surfactant containing at least one fluorine atom. The fluorinated surfactant can be a fluorine-containing polymeric surfactant including a fluorine graft copolymer. For example, the fluorinated surfactant can be a methacrylate-based fluorosurfactant, such as, for example, polyfluoroacrylate derivative of a methylmethacrylate, and/or a polyfluoroacrylate methylmethacrylate. In one embodiment, the fluorinated surfactant can have a general formula as follows:

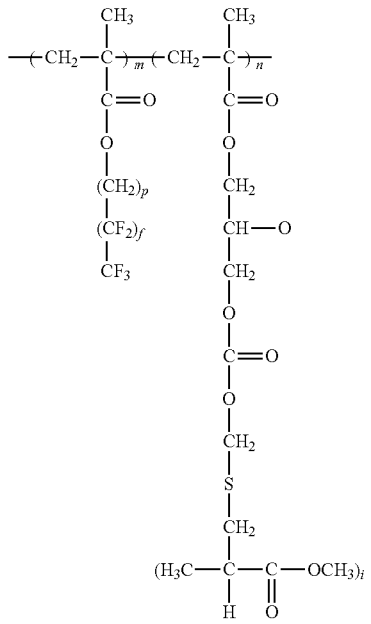

wherein m and n independently represent integers of from about 1 to about 300, or from 1 to about 200 or from about 10 to about 100, p represents an integer of from about 1 to about 20 or from about 5 to about 15 or from about 5 to about 10, and i represents an integer of from about 1 to about 500, or from about 1 to about 100 or to about 200, or from about 5 to about 75. In embodiments, it is desired that the number of side chains can be substantially equal. That is, it is desired that the variables m and n differ by less than about 10%, such as less than about 5% or less than about 1%, or be selected such that m=n. In some embodiments, m and n independently represent integers of from about 1 to about 99, p represents an integer of from about 1 to about 10, f represents an integer of from about 0 to about 8, and i represents an integer of from about 10 to about 500.

Non-limiting examples of the fluorinated surfactant can include poly(fluoroacrylate)-graft-poly(methyl methacrylate) surfactant, fluorinated acrylate copolymer with pendant glycol and/or perfluoroalkyl sulfonate groups surfactant, polyether copolymers with pendant trifluoroethoxy group surfactant, and the like, or combinations thereof. For example, the poly(fluoroacrylate)-graft-poly(methyl methacrylate) surfactant can have weight average molecular weight of about 25,000 or higher. Commercially available products for the fluorinated surfactants can include, for example, GF-300 or GF-400 available from Toagosei Chemical Industry Co., Ltd. Another suitable commercial methacrylate-based fluorinated surfactant or fluorosurfactant product can include, for example, Fluor N 489 by Cytonix Corp., a methacrylate fluorosurfactant. Others can include GF-150 from Tongosei Chemical Industries; MODIPER F-600 from Nippon Oil & Fats Company; SURFLON S-381 and S-382 from Asahi Glass Company; FC-430, FC-4430, FC-4432 and FC-129 from 3M; etc.

In embodiments, the incorporation of leveling agents can facilitate stable and uniform dispersing of PFA powder and/or aerogel particles in the powder mixture composition and the powder mixture to provide desired coating quality and desired properties of the final fluoroplastic coating layer. For example, the amount of the leveling agent can depend on the amount of PFA powder and/or aerogel particles present in the powder mixture or its composition. For example, as the amount of PFA powder and/or aerogel particles is increased, the amount of the leveling agent of the fluorinated surfactant can be proportionally increased in order to maintain the dispersing quality and thus the coating quality. For example, a weight ratio between the fluorinated surfactant to a total of the PFA powder and/or aerogel particles can be from about 0.1% to about 5%, or from about 0.3% to about 3%, or from about 0.5% to about 2%.

As used herein, the term "binder material" refers to a polymer binder material in the powder mixture composition and its dry powder mixture to connect the plurality of aerogel particles with the plurality of fluoroplastic powder via the binder materials, such that homogeneous powder mixture composition and thus homogeneous dry powder mixture can be formed. In embodiments, the binder materials as disclosed herein can also be referred to as "transient binder materials," because the binder materials can be removed during the subsequent curing process of the powder coating layer. As a result, a uniform coating layer is formed that includes aerogel particles dispersed within a fluoroplastic polymer matrix.

In embodiments, the binder materials can include, but are not limited to, poly(alkylene carbonate) (PAC) including poly (propylene carbonate) (PPC), polyethylene carbonate), copolymer of propylene carbonate and ethylene carbonate, and/or combinations thereof.

Figure 2:
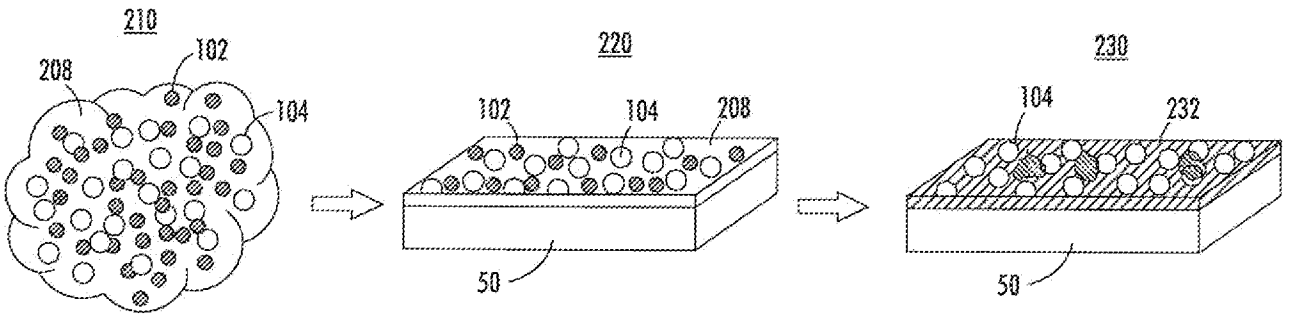

FIGS. 1-2 depict various exemplary methods for forming a fluoroplastic coating layer in accordance with various embodiments of the present teachings.

In FIG. 1, an exemplary powder mixture 110 can be formed to include a plurality of PFA powder 102, a plurality of aerogel particles 104, and a fluorinated surfactant as a leveling agent 106. The powder mixture 110 can be formed from, e.g., drying a corresponding powder mixture composition including PFA powder, aerogel particles, and the fluorinated surfactant in one or more solvents.

The powder mixture 110 can then be applied, for example, powder coated onto a substrate 50 to form a coated substrate 120. The powder mixture 110 can be applied electrostatically or in other means and then cured under heat to allow the fluoroplastic powder 102 to flow and form a fluoroplastic film or a fluoroplastic coating layer. The resulting fluoroplastic coating layer 132 on the substrate 50 of the cured substrate 130 can include aerogel particles 104 leveled by the leveling agent 106 during the curing process.

The curing temperature in FIG. 1 can be determined depending on selection of the fluoroplastic powder, the aerogel particles, and the leveling agent. For example, the curing temperature in FIG. 1 can be in the range from about 285° C. to about 380° C., or from about 290° C. to about 370° C., or from about 300° C. to about 350° C. In embodiments, following the curing process, the leveling agent 106 can be at least partially maintained in the resulting fluoroplastic coating layer 132 as shown in FIG. 1. In other embodiments, the leveling agent 106 can be removed from the resulting fluoroplastic coating layer 132.

Because the leveling agent can facilitate a uniform dispersing of the PFA powder and aerogel particles in the powder mixture composition and the dry powder mixture, the formed fluoroplastic coating layer 132 can be a continuous coating layer having high coating quality with minimum or no surface defects. In embodiments, the fluoroplastic coating layer 132 can be uniform and/or non-porous.

In FIG. 2, an exemplary powder mixture 210 can be formed to include a plurality of PFA powder 102, a plurality of aerogel particles 104, and a binder material 208. In embodiments, the aerogel particles 104 can be attached to the PFA powder 102 via the binder material 208. The powder mixture 210 can be formed from, e.g., drying a corresponding powder mixture composition including PFA powder, aerogel particles, and the binder material in one or more solvents.

The powder mixture 210 can then be applied, for example, powder coated onto a substrate 50 to form a coated substrate 220 using powder coating techniques. The coated substrate 220, including aerogel particles 104 attached to the PFA powder 102 via the binder material 208, can then be cured to form a cured substrate 230 including a fluoroplastic coating layer 232 cured from the plurality of fluoroplastic powder 102 on the substrate 50.

The curing temperature in FIG. 2 can be determined depending on selection of the fluoroplastic powder, the aerogel particles, and the binder material. For example, the curing temperature in FIG. 2 can be selected to be greater than a decomposition temperature of the binder material such that the binder material can be removed by the curing process. In embodiments, the curing temperature can be in the range from about 285° C. to about 380° C., or from about 290° C. to about 370° C., or from about 300° C. to about 350° C.

Following the curing process, the fluoroplastic coating layer 232 can include the aerogel particles 104, e.g., uniformly dispersed within the coating layer 232. The fluoroplastic coating layer 232 do not include the binder material due to the decomposition. Because of this transient feature, use of binder materials can have no impact on the performance of the final fluoroplastic coating layer but provide desirable interaction between the PFA powder and the aerogel particles during formation. The formed fluoroplastic coating layer 232 can be a continuous coating layer having high coating quality with minimum or no surface defects. In embodiments, the fluoroplastic coating layer 232 can be uniform and/or non-porous.

In embodiments, an exemplary powder mixture can be formed by combining the methods in FIGS. 1-2 to include both leveling agent 106 and binder material 208 as well as the exemplary PFA powder 102 and the aerogel particles 104. In this case, the aerogel particles can be leveled by the leveling agent such as a fluorinated surfactant, and can further be attached to the PFA powder via the binder material. The powder mixture can be formed from, e.g., drying a corresponding powder mixture composition including PFA powder, aerogel particles, the leveling agent, and the binder material in one or more solvents.

The powder mixture including both the leveling agent 106 and the binder material 208 can then be powder coated onto a substrate to form a coated substrate using powder coating techniques. The coated substrate that includes aerogel particles leveled by the leveling agent and attached to the PFA powder via the binder material can then be cured to form a fluoroplastic coating layer from the fluoroplastic powder on the substrate surface. In this case, the curing temperature can be in the range from about 285° C. to about 380° C., or from about 290° C. to about 370° C., or from about 300° C. to about 350° C. As a result, the fluoroplastic coating layer can include aerogel particles dispersed within the coating layer. The fluoroplastic coating layer may or may not include the leveling agent and/or the binder material. The fluoroplastic coating layer can also be a continuous film having high quality with low or no surface defects. The formed fluoroplastic coating layer can be uniform and/or non-porous.

In embodiments, the resulting fluoroplastic coating layer (e.g., see 132/232 in FIGS. 1-2) can be formed to have a thickness ranging from about 10 μm to about 100 μm, or from about 20 μm to about 80 μm, or from about 30 μm to about 50 μm. The resulting fluoroplastic coating layer can be formed to provide desired uniform properties including, such as, for example, surface, electrical, mechanical, thermal and/or chemical properties. The resulting fluoroplastic coating layer can have a surface roughness ranging from about 0.1 μm to about 5 μm, or from about 0.5 μm to about 3 μm, or from about 1 μm to about 2 μm.

Figure 3:
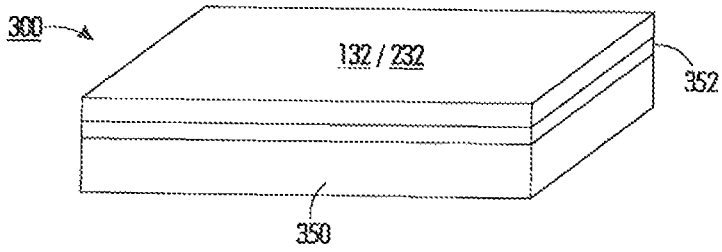
FIGS. 3-5 depict various exemplary fuser members including a fluoroplastic coating layer as a topcoat layer in accordance with various embodiments of the present teachings.

In embodiments, the cured substrate 130/230 in FIGS. 1-2 can be used as a printer member, such as a fuser member, in accordance with various embodiments of the present teachings, wherein the substrate 50 is a fuser substrate (see 350 in FIG. 3) in a form of a belt, a film, or a sheet. In embodiments, another exemplary fuser belt can include a base layer 352 formed between a fuser substrate 350 and the exemplary fluoroplastic coating layer 132/232 as a topcoat layer, as shown in FIG. 3. The base layer 352 can include one or more functional layers including, but not limited to, an elastomer layer, an intermediate layer, and/or an adhesive layer.

Figure 4:
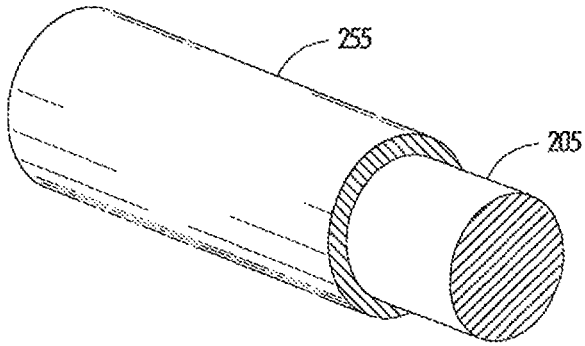
Figure 5:
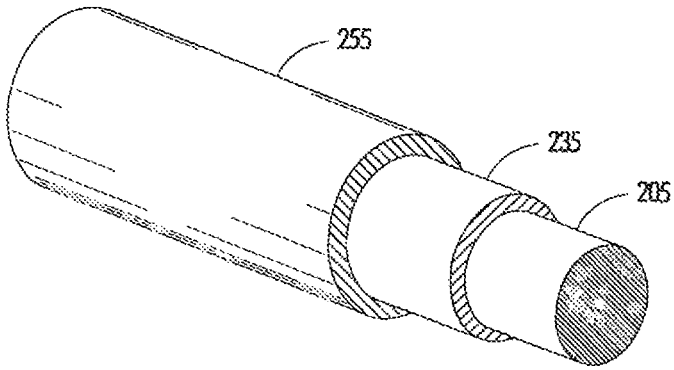

In embodiments, the fluoroplastic coating layer 132/232 in FIGS. 1-2 can be formed as a topcoat layer of a fuser member as depicted in FIGS. 4-5, wherein the fuser substrate 205 can take the form of, e.g., a cylindrical tube, a solid cylindrical shaft, or a drelt.

In FIG. 4, the topcoat layer, for example, the fluoroplastic coating layer 255, for example, the fluoroplastic coating layer 132/232, can be formed directly on a fuser substrate 205. In FIG. 5, the topcoat layer 255, for example, the fluoroplastic coating layer 132/232, can be formed over a base layer 235 that includes one or more functional layers as disclosed herein. The base layer 235 can be formed over the fuser substrate 205.

In embodiments, the fuser substrate 350/205 in FIGS. 3-5 can be made of a material including, but not limited to, a metal, a plastic, and/or a ceramic. For example, the metal can include aluminum, anodized aluminum, steel, nickel, and/or copper. The plastic can include polyimide, polyester, polyetheretherketone (PEEK), poly(arylene ether), and/or polyamide.

The elastomer layer of the base layer 352 in FIG. 3 and the base layer 235 in FIG. 5 can be formed of materials including, for example, isoprenes, chloroprenes, epichlorohydrins, butyl elastomers, polyurethanes, silicone elastomers, fluorine elastomers, styrene-butadiene elastomers, butadiene elastomers, nitrile elastomers, ethylene propylene elastomers, epichlorohydrin-ethylene oxide copolymers, epichlorohydrin-ethylene oxide-allyl glycidyl ether copolymers, ethylene-propylene-diene (EPDM) elastomers, acrylonitrile-butadiene copolymers (NBR), natural rubber, and the like, and combinations thereof. The use of the fluoroplastic coating layer 132/232 with high coating quality and desired properties can provide high printing quality.

EXAMPLES

Example 1

Control Example—Coating Preparation of Aerogel/PFA

About 100 grams of PFA powder mixture, containing about 2.5 grams hydrophobic silica aerogel (VM2270 aerogel powder, Dow Corning), was dispersed in isopropanol (IPA) with sonication to form well dispersed PFA composite dispersion of about 500 gram. After removing the solvent by evaporation and drying under vacuum, dry PFA powder mixture was collected.

Fuser rolls were produced by wet spraying a primer layer (DuPont PL-990CL) of about 3 μm to about 5 μm for adhesion, then applying the PFA powder mixtures on the primed rolls by electrostatic powder-coating process to make an aerogel/PFA topcoat layer of about 25 μm to about 35 μm. These rolls were then rapidly heated for about 10 to about 15 minutes from room temperature in a convection oven to a curing temperature of about 330° C. and held stable for about 20 minutes to form a continuous film. The oven was then opened to cool the fuser rolls to about 235° C. in about 5 minutes prior to placing the fuser rolls to the room temperature environment.

As observed from SEM images, the resulting aerogel/PFA coating layer included voids throughout the layer, indicating lack of interactions between the aerogel particles and the PFA polymer matrix.

Example 2

Coating Preparation Using Surfactant GF-400

About 100 grams of PFA powder mixture, containing about 2.5 grams hydrophobic silica aerogle (VM2270 aerogel powder, Dow Corning), was dispersed in methyl ethyl ketone (MEK) solution having about 0.8 grams of GF-400 fluorine group-containing graft polymer made by Toagosei Co., Ltd. (Japan) by sonication and to form homogeneous aerogel/PFA composite dispersion of about 250 grams. The dry PFA powder mixture containing GF-400 was collected by removing the solvent MEK via evaporation and drying under vacuum.

Fuser rolls were then formed following the procedure described in Example 1 by powder coating the PFA powder mixture containing GF-400 on a primed fuser roll. The resulting coating layer was a non-porous and uniform layer, as observed by SEM images, indicating GF-400 efficiently improved the interfacial interactions between PFA powder and aerogel particles by wetting and leveling the aerogel particles during PFA melting process of powder coating.

Example 3

Control Example—Coating Preparation of Aerogel/PFA

About 10 grams of PFA powder was dispersed in methylethylketone (MEK) with sonication and milling to make about 20 g PFA dispersion. About 0.25 grams of aerogel particles was dispersed in MEK to make about 5 grams of dispersion. Mix both PFA and aerogel dispersions by milling. The dry powder mixture containing 2.5% of aerogel particles was collected by removing the solvent MEK via evaporation and drying under vacuum.

Example 4

Coating Preparation Using Transient Binder Material PPC

About 10 grams of PFA powder was dispersed in methylethylketone (MEK) with sonication and milling to make about 20 g PFA dispersion. About 0.25 grams of aerogel particles was dispersed in MEK to make about 5 grams of dispersion. About 0.625 grams of MEK solution having about 20% of the poly(propylene carbonate) (PPC) binder polymer with molecular weight of about 265,000 g/mol (Empower Materials—QPAC® 40) was added to the aerogel dispersion, which was then mixed with the PFA dispersion by milling to form a powder dispersion of about 25 grams. The dry powder mixture containing about 2.5 wt % of aerogel particles and about 1.3 wt % of PPC was collected by removing the solvent MEK via evaporation and drying under vacuum.

Comparing the optical microscopic images of the powder mixture prepared in Examples 3-4, individual aerogel particles without using the transient binder material PPC were observed loosely distributed in powder mixture, while the aerogel particles were observed substantially completely bound to PFA particles by the PPC transient binder material. For example, aerogel particles with rough surfaces and granular shapes were bonded with the spherical and smooth PFA particles by PPC.

Fuser rolls were then produced, as depicted in Example 1, by electrostatically powder coating the powder mixture formed in Examples 3 and/or 4 to form aerogel/PFA topcoat layers. As a result, the topcoat layer formed using the transient binder material provided a uniform distribution of the aerogel particles in a continuous PFA coating layer without generating any voids. However, the topcoat layer formed without using the transient binder material was observed non-continuous and non-homogeneous.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A powder coating method of making a coating layer comprising:

forming a powder mixture comprising a plurality of fluoroplastic powder, a plurality of aerogel particles, and a leveling agent comprising a fluorinated surfactant;

applying the powder mixture to a material surface; and curing the applied powder mixture to form a fluoroplastic coating layer from the plurality of fluoroplastic powder on the material surface, wherein the plurality of aerogel particles are leveled by the leveling agent during curing to disperse within the fluoroplastic coating layer.

2. The method of claim 1, wherein the step of forming a powder mixture comprises:

forming a powder mixture composition by dispersing the plurality of fluoroplastic powder, the plurality of aerogel particles, and the leveling agent in one or more solvents; and removing the one or more solvents from the powder mixture composition to form the powder mixture.

3. The method of claim 1, wherein the plurality of fluoroplastic powder comprise a plurality of polyfluoroalkoxypolytetrafluoroethylene (PFA) powder present in an amount ranging from about 80 percent to about 99.9 percent by weight of the total powder mixture.

4. The method of claim 1, wherein the plurality of fluoroplastic powder comprise a plurality of PFA powder having an average powder size ranging from about 5 μm to about 50 μm.

5. The method of claim 1, wherein the plurality of aerogel particles are present in an amount ranging from about 0.1 percent to about 10 percent by weight of the total powder mixture.

6. The method of claim 1, wherein the plurality of the aerogel particles have an average particle size ranging from about 100 nm to about 30 μm.

7. The method of claim 1, wherein the plurality of aerogel particles are formed of a material selected from the group consisting of alumina, silica, carbon, zirconia, titania, silicon carbide, silicon nitride, tungsten carbide, and a combination thereof.

8. The method of claim 1, wherein the fluorinated surfactant has a general formula of:

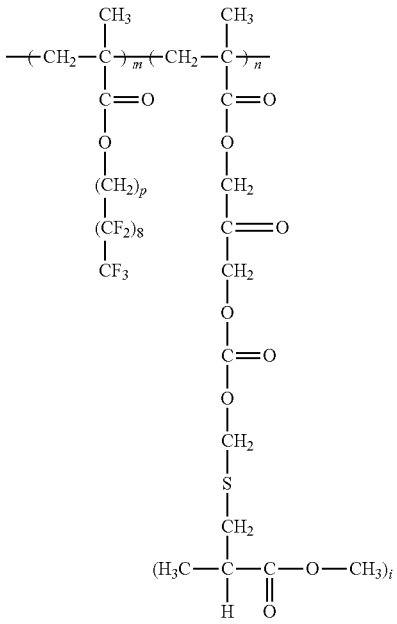

wherein m and n independently represent integers of from about 1 to about 300, p represents an integer of from about 1 to about 20, and i represents an integer of from about 1 to about 500.

9. The method of claim 1, wherein the fluorinated surfactant is selected from the group consisting of poly(fluoroacrylate)-graft-poly(methyl methacrylate) surfactant, fluorinated acrylate copolymer with pendant glycol surfactant, fluorinated acrylate copolymer with perfluoroalkyl sulfonate surfactant, polyether copolymers with pendant trifluoroethoxy group surfactant, and a combination thereof.

10. The method of claim 1, wherein a weight ratio between the fluorinated surfactant to a total of the plurality of PFA powder and the plurality of aerogel particles ranges from about 0.1% to about 5%.

11. The method of claim 1, wherein the powder mixture is cured at a curing temperature ranging from about 290° C. to about 350° C.

12. A method of making a coating layer comprising:

forming a powder mixture comprising a plurality of fluoroplastic powder, a plurality of aerogel particles, and a transient binder material, wherein the plurality of aerogel particles are attached to the plurality of fluoroplastic powder via the transient binder material;

applying the powder mixture to a material surface; and curing the applied powder mixture to form a fluoroplastic coating layer from the plurality of fluoroplastic powder on the material surface and to remove the transient binder material such that the plurality of aerogel particles are dispersed within the fluoroplastic coating layer.

13. The method of claim 12, wherein the step of forming a powder mixture comprises:

forming a powder mixture composition by dispersing the plurality of fluoroplastic powder, the plurality of aerogel particles, and the transient binder material in one or more solvents; and removing the one or more solvents from the powder mixture composition to form the powder mixture.

14. The method of claim 12, wherein the powder mixture is cured at a curing temperature substantially higher than a decomposition temperature of the transient binder material, wherein the curing temperature ranges from about 285° C. to about 380° C.

15. The method of claim 12, wherein the transient binder material comprising poly(alkylene carbonate) (PAC) is selected from the group consisting of poly(propylene carbonate) (PPC), poly(ethylene carbonate) (PEC), copolymer of ethylene carbonate and propylene carbonate, and a combination thereof.

16. A powder coating method of making a fuser member comprising:

forming a powder mixture comprising a plurality of aerogel particles, a plurality of polyfluoroalkoxypolytetrafluoroethylene (PFA) powder, and one or more of a leveling agent, a transient binder material, and a combination thereof;

applying the powder mixture to one of an elastomer layer of a fuser member and a fuser member substrate; and curing the applied powder mixture to form a fluoroplastic coating layer from the plurality of fluoroplastic powder as a topcoat layer of the fuser member such that the plurality of aerogel particles are uniformly dispersed within the fluoroplastic coating layer to provide a surface roughness ranging from about 0.1 μm ($S_q$) to about 5 μm ($S_q$).

17. The method of claim 16, wherein the fluoroplastic coating layer has a surface roughness ranging from 0.5 μm to about 3 μm.

18. The method of claim 16, further comprising forming a primer layer prior to applying the powder mixture thereto.

19. The method of claim 16, wherein the step of applying the powder mixture comprises an electrostatic powder-coating process.

20. The method of claim 16, wherein the fluoroplastic coating layer has a thickness ranging from about 10 μm to about 100 μm.

* * * * *